US006769795B1

(12) United States Patent
Hale

(10) Patent No.: US 6,769,795 B1
(45) Date of Patent: Aug. 3, 2004

(54) LIGHTED GAME AND LIGHT FOR A GAME HAVING A NET

(76) Inventor: Roger G. Hale, 7305 Vanessa Dr., Fort Worth, TX (US) 76112

( * ) Notice: Subject to any disclaimer, the term of this patent is extended or adjusted under 35 U.S.C. 154(b) by 0 days.

(21) Appl. No.: 10/346,140

(22) Filed: Jan. 16, 2003

(51) Int. Cl.[7] ..... F21V 21/088; F21S 8/08

(52) U.S. Cl. ..... 362/396; 362/152; 362/414; 362/431

(58) Field of Search ..... 362/145, 152, 362/234, 253, 249, 252, 396, 410, 413, 414, 431; 473/475, 490–493, 496

(56) References Cited

U.S. PATENT DOCUMENTS

| | | | | |
|---|---|---|---|---|
| 3,971,560 A | | 7/1976 | Panosh | |
| 4,236,193 A | * | 11/1980 | Brandt | 362/431 |
| 5,124,899 A | | 6/1992 | Hale | |
| 5,209,562 A | | 5/1993 | Glassford | |
| 5,417,438 A | | 5/1995 | Poff | |
| 5,436,811 A | * | 7/1995 | Hecking | 362/152 |
| 5,664,875 A | | 9/1997 | Hegedus | |
| 5,733,210 A | | 3/1998 | Yiu | |
| 5,791,758 A | | 8/1998 | Horgan et al. | |
| 5,941,778 A | | 8/1999 | Vasalech | |
| 6,168,541 B1 | | 1/2001 | Gibbs | |
| 6,416,207 B1 | * | 7/2002 | Chang | 362/414 |

FOREIGN PATENT DOCUMENTS

| | | | | |
|---|---|---|---|---|
| FR | 2645944 A1 | * | 10/1990 | 362/252 |

OTHER PUBLICATIONS

Owner's Manual; Fold and Roll Payback Table Tennis Table; Net Assembly; pp. 1–5 Evansville, IN.; 2002.

Stiga, Net and Post Set, Instruction Manual, p. 1 www.escaldesports.com.

www.tt–shop.com/en/producttemplates/; Donic Stress Net; Donic Clip; Dec. 16, 2002; pp. 2.

www.onlinesports.com/images/; table tennis nets; Dec. 16, 2002; pp. 2.

www.spacesavers.com; Mighty Bright Clip Light; Oct. 1, 2002; p. 1.

sell–it–on–the–net.com/; Table Top Light Kit; Oct. 17, 2002; pp. 2.

www.checkolite.com/; Clamp Light; W12661; Oct. 17, 2002; p. 2.

www.drsfostersmith.com/product/prod_Display.cfm; dated Oct. 17, 2002; Clamp Light; p. 1.

store4.yimg.com/; Regent Worklight; Oct. 17, 2002; p. 1.

www.stacksandstacks.com/; Clip–On Light–Gooseneck; Oct. 17, 2002; p. 1.

shop.store.yahoo.com/; Brita 35–Watt Halogen Clamp Light; Oct. 17, 2002; p. 1.

* cited by examiner

*Primary Examiner*—Alan Cariaso
(74) *Attorney, Agent, or Firm*—Geoffrey A. Mantooth; L. Bruce Terry

(57) ABSTRACT

There is provided a light for net type games, whether they be court type games, such as volleyball, or table games, such as ping pong. The light is positioned adjacent to the end of the net and may be mounted to the net supporting structure or pole or mounted directly to the table in the case of a ping pong table. The light is positioned laterally of the playing field at a level that is above the net so that light is directed onto the playing surface and onto the net.

10 Claims, 7 Drawing Sheets

LIGHTED GAME AND LIGHT FOR A GAME HAVING A NET

BACKGROUND OF THE INVENTION

1. Field of the Invention

The present invention relates generally to lighting of competitive games having a net, and more particularly to a lighted game having a game light supported near a net post in a game having a net.

2. Description of the Prior Art

Many competitive games use a net that divides a playing court into two sides, one for each player or team. Examples of such "net-sports" include games like table tennis, volleyball, badminton, and tennis.

To support the net over the court, net posts may be used, with the net strung under tension between two posts on either side of the court. In table tennis, the net posts are part of a bracket that is connected in the middle of the table. The connection of the bracket to the table is frequently made with clamps, screws, or bolts. Clamps are typically held in place by applying pressure to the top and bottom of the table. Bolts and screws may be used to mount the bracket to the bottom of the table, leaving the top of the table clear.

In volleyball, badminton, and tennis, the net posts are typically in contact with the ground near the sideline boundaries of the court. The net posts may be supported by wires extending away from the sidelines of the court, or securely mounted in the ground without support wires.

Many times players will want to play these net sports in areas that are poorly lit, either at night outdoors, or indoors in areas with insufficient lighting, such as a basement or garage. Poor lighting makes the games more difficult to play, and much less enjoyable.

Therefore, a need exists for a lighted game having a net dividing a court, and a light for lighting a game having a net that divides a court into sides for players.

SUMMARY OF THE INVENTION

The present invention provides a light for a game, wherein the game uses a net supported by a net post. The light comprises a conduit having a light end and a mounting end. A light source housing is coupled to the light end of the conduit, wherein the light source housing has a socket for supporting and coupling power to a light source. A mounting means is coupled to the mounting end of the conduit for attaching the conduit to the net post.

In accordance with one aspect of the present invention, the mounting means is a clamp. The mounting means can be a screw clamp or a spring clamp. The clamp can include a clamp arm having a clamping surface shaped to conform to a corresponding shape in the net post.

In accordance with another aspect of the present invention the conduit includes an offset that positions the light out of a space for playing the game when coupled to a net post.

In accordance with another aspect of the present invention the conduit is a bendable shaft.

In accordance with another aspect of the present invention the clamp opens and closes in a plane perpendicular to a net post and the conduit extends upward and away from the net such that the light source is outside the perimeter of a playing court and above a net attached to the net post.

In accordance with another aspect of the present invention there is a light source shade coupled to the light source housing.

In accordance with another aspect of the present invention the light source shade blocks light from shining into the eyes of a player in a playing position.

The present invention provides a lighted net post for a game having a net suspended across a court. The net post comprises a net post assembly for supporting a net perpendicularly above a playing surface for the game. The net post has a net side from which a suspended net extends away from the net post. A light support is coupled to the net post assembly, wherein the light support extends upward and away from the net post on a side of the net post opposite the net side. A light source housing is coupled to the light support wherein the light source is located above the net post, wherein the lighted net post is used. The light source housing is located outside a playing space above a court area for the game.

In accordance with one aspect of the present invention the light support is a shaft.

In accordance with another aspect of the present invention the light source housing includes a socket and further includes an adjustable shade coupled to the light source housing. The shade blocks light from shining into the eyes of a player in a playing position. The shade also adjusts along the side of the light source housing.

In accordance with another aspect of the present invention the light support is a bracket that supports the light at the level of the net.

In accordance with another aspect of the present invention the game is table tennis, wherein the light support is coupled to the table near an intersection of the net and a sideline.

In accordance with another aspect of the present invention the light support is clamped to the table or is attached to the table with a fastener.

In accordance with another aspect of the present invention the game is volleyball, wherein the light support is coupled to the net support for a volleyball net.

In accordance with one aspect of the present invention the light support is clamped to the net support for the volleyball net or is bolted to the net support.

BRIEF DESCRIPTION OF THE DRAWINGS

For a more complete understanding of the present invention, and the advantages thereof, reference is now made to the following descriptions taken in conjunction with the accompanying drawings, in which like numbers designate like parts, and in which.

DESCRIPTION OF THE PREFERRED EMBODIMENTS

The present invention may have several embodiments, including an embodiment for table tennis and an embodiment for volleyball, or other net-sports played on the ground. Embodiments for both table tennis and volleyball may have embodiments that are attached to an existing net post, and embodiments wherein the game light is integrated or combined with a new net post, so that the game light net post combination replaces an existing net post with a lighted net post.

Figure 1:
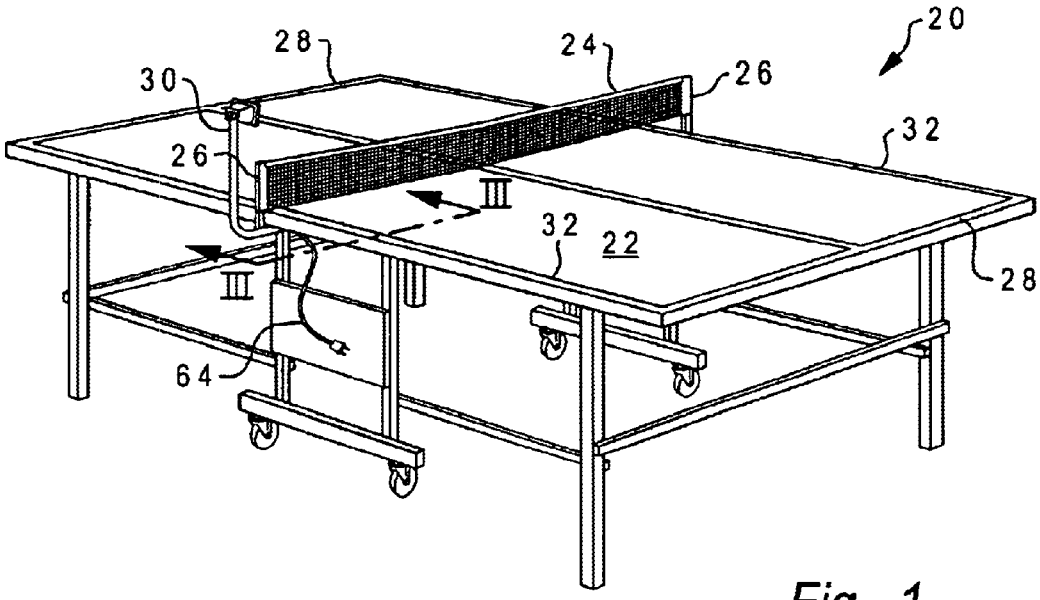
FIG. 1 is a perspective view of a table tennis table having a game light in accordance with an embodiment of the present invention.

With reference now to the drawings, and in particular with reference to FIG. 1, there is a depicted a perspective view of a table tennis table 20. As shown, table 20 includes playing surface 22, and net 24 supported by net posts 26, which may also be referred to as net supports. Playing surface 22 is typically rectangular, measuring 2.74 meters long and 1.525 meters wide, lying in a horizontal plane 76 centimeters above the floor. The playing surface is divided into two equal courts by vertical net 24 running parallel with end lines 28.

In accordance with the present invention, game light 30 is positioned above playing surface 22 near, or adjacent to, net post 26 and outside of sidelines 32. Game light 30 efficiently and effectively illuminates playing surface 22 and the area above playing surface 22 so that players can see the court, the net, and the ball above the court during play, without the glare of the light source in the player's eyes. For even more light, or for more even illumination, game lights 30 may be placed on both ends of net 24.

Figure 2:
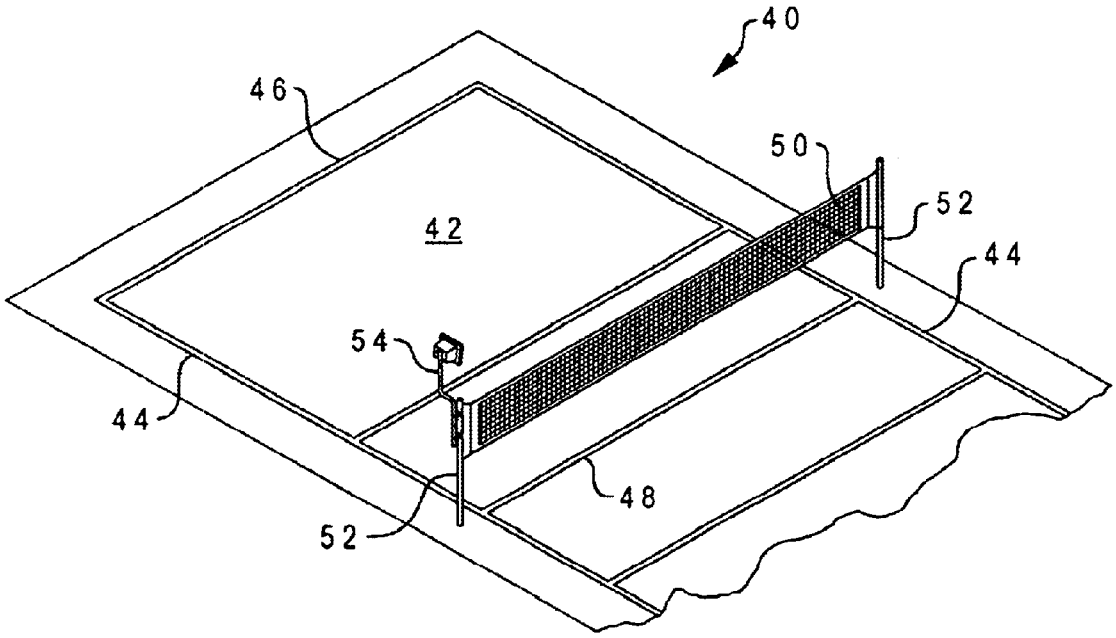
FIG. 2 is a perspective view of a volleyball court having a game light in accordance with an embodiment of the present invention.

Referring now to FIG. 2, there is depicted a volleyball court 40 having a playing surface 42, which may be grass, sand, wood, or the like. Playing surface 42, or the court area, is typically rectangular, measuring 18 meters by 9 meters, and having a surrounding free zone that is a minimum of 3 meters wide. Boundary lines consist of two sidelines 44 and two end lines 46. Center line 48 divides the playing court into two 9 meter by 9 meter square team courts.

Net 50 is supported by net posts 52 vertically over center line 48. Net posts 52 are typically 30 centimeters to 1 meter outside each sideline 44. The height of the net is typically 2.43 meters for men and 2.24 meters for women. The net is not less than 9.5 meters long and 1 meter wide.

Net posts are typically rounded and smooth. Posts may be secured to the playing surface, and may also use guide lines for securing posts to the ground.

In accordance with the present invention, game light 54 for volleyball is positioned above playing surface 42 near centerline 48, adjacent to net post 52, and outside of sidelines 44. Game light 54 illuminates playing surface 42, net 50, and the playing area or space above playing surface 42 while reducing the amount of glare in the player's eyes. Such a playing area or playing space may be defined as the space, used by a ball or players, in which the game is expected, under typical playing conditions, to be played.

To provide more light, or for more even illumination, game lights 54 may be placed on both ends of net 50. If lights are used on both ends of a net, one light may be used to primarily illuminate one player's or team's court, while the other light is used to illuminate the other player's or team's court.

With reference now to FIGS. 3–6, there are depicted several means for mounting game light 30 for table tennis above and outside playing surface 22. In each of FIGS. 3–5, net 24 is supported by net post 26, which is 2s coupled to bracket 60 that mounts to table or playing surface 22. Together, net post 26 and bracket 60 may be referred to as net post assembly 62.

Net post assembly 62 may be coupled to table 20 in many different ways. For example, net post assembly 62 may include a C-clamp (similar to that shown in FIG. 14) that clamps to the top and bottom playing surface 22. Other means of attachment include using a bolt that extends through bracket 60 and either a hole in playing surface 22, or through the narrow gap between table halves of a folding table. Yet another means of attachment includes brackets that are fastened to the bottom of the table, or to other frame members that support the table.

Figure 9:
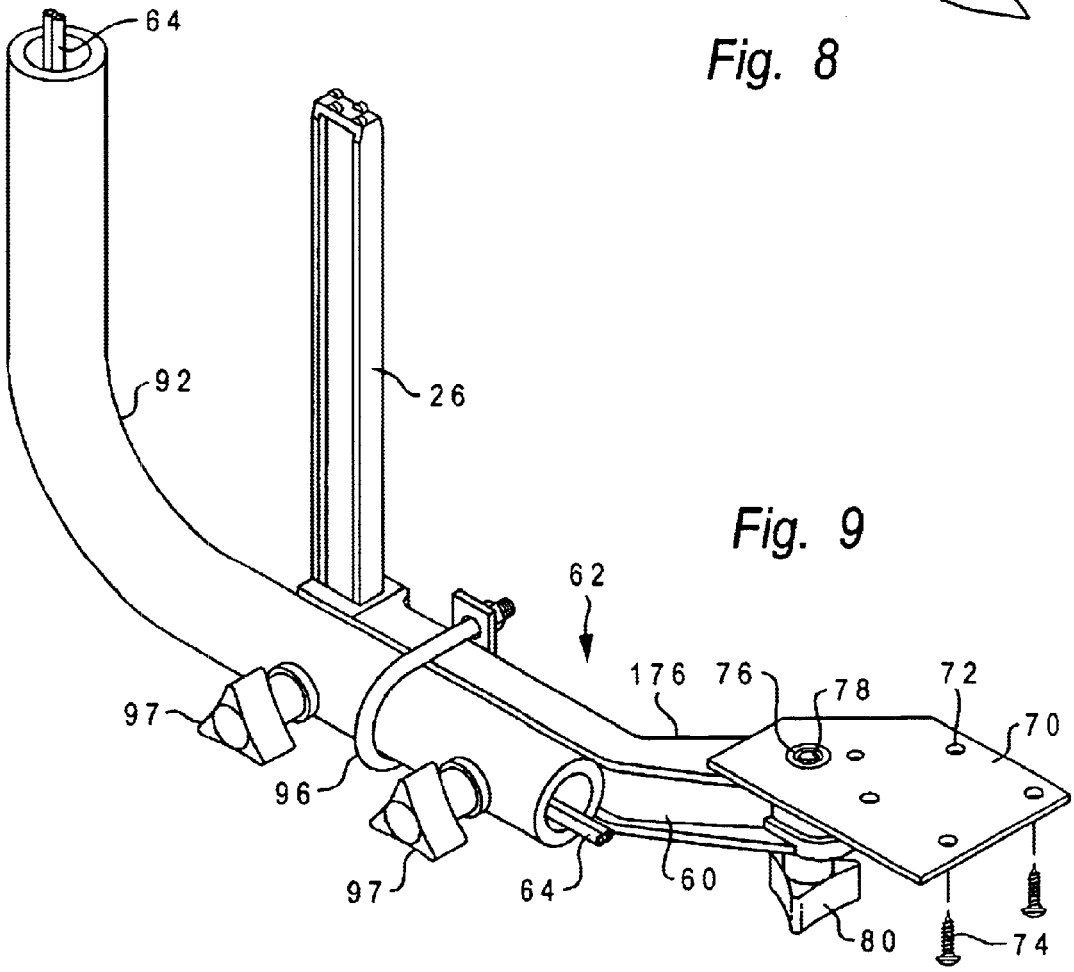
FIG. 9 is a perspective view of a means for mounting a game light conduit to a net post bracket in accordance with FIG. 3 of the present invention.

A more specific example of means for attaching a net to the bottom of the table is illustrated in FIG. 9. As shown, nut plate 70 includes holes 72, through which screws 74 are used fasten nut plate 70 to the bottom of playing surface 22. Nut plate 70 includes a threaded opening, such as nut 76, for receiving bolt 78, which has a knob 80 for tightening bolt 78 into nut 76. Bracket 60, which is coupled to nut plate 70 by bolt 78, extends from beneath playing surface 22 and supports net post 26 perpendicular to playing surface 22, about 10 centimeters beyond sideline 32 (see FIG. 1). In the preferred embodiment, bracket 60 is shaped like an I-beam that has an angle along its length, so as not to be straight. The angle, or centering offset 176, allows the mounting of nut plate 70 on one table-half, on one side of the net, while supporting net post 26 in the middle of the table, over the center line, between the two halves or courts of the table. Mounting nut plate 70 to the bottom of one table-half permits a folding table design where the folding action does not interfere with the mounting bracket.

Figure 3:
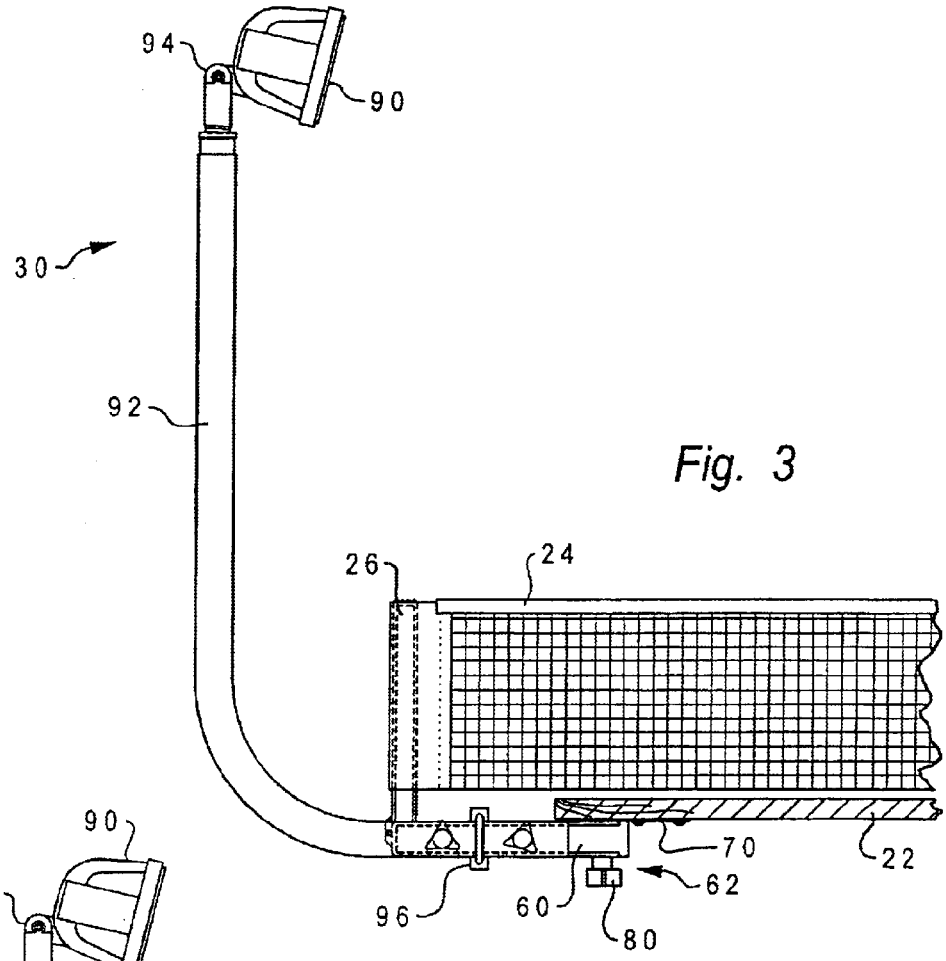
FIG. 3 is a side view taken along a line III—III in FIG. 1, which shows a game light mounted to a net post bracket in accordance with the present invention.

As depicted in the embodiment of FIGS. 3 and 9, game light 30 may be mounted as an add-on, or accessory, to bracket 60, which may have been included by a table manufacturer as original equipment with a table tennis table. This add-on embodiment of game light 30 includes light housing 90 coupled to conduit 92 by pivot joint 94. Conduit 92 may also be referred to as a light support, or an elongate shaft. Light housing 90 and conduit 92 are made from a durable, ridged material that protects and supports a light source (not shown) within light housing 90. Conduit 92 also surrounds and protects wire 64 that supplies power to the light source. In a preferred embodiment, light housing 90 and conduit 92 are made from metal. Alternatively, plastic may be used to construct light housing 90 and conduit 92. While a preferred design has wire 64 inside conduit 92, wire 64 may also be secured along the outside of conduit 92. Alternative embodiments may also include a flexible or bendable conduit 92 like a gooseneck tube.

Pivot joint 94 permits aiming of the light source onto playing surface 22 and the area above playing surface 22. Pivot joint 94 may be implemented with a ball-and-socket joint, a hinge joint secured by a nut and bolt, or the like.

Conduit 92 may be relatively straight, or include curves to provide an offset away form playing surface 22 so that light housing 90 is supported an appropriate distance outside the field and area of play to avoid interference with play. If conduit 90 is relatively straight, it may extend at an angle upward from playing surface 22 to light housing 90, which is held away from sideline 32. A curved offset at the lower end of conduit 92 is shown in FIGS. 3–6. A curved offset near the middle of conduit 92 is shown in FIG. 5.

The coupling of conduit 92 to bracket 60 is shown in more detail in FIG. 9. In a preferred embodiment, one or more bracket clamps 96 are used to clamp conduit 92 securely to bracket 60. Alternatively, the coupling may be implemented using bolts 97 (which are shown with knobs for hand tightening) that pass through conduit 92 and bracket 60. Conduit 92 may be mounted on either side of bracket 60, or on the bottom or top of bracket 60.

Bracket clamp 96 in FIG. 9 may be implemented with U-bolt fasteners that use U-bolts, nuts, and bolt plates to securely fasten conduit 92 to bracket 60. The U-bolt may be selected to match the diameter of conduit 92 and the bolt plate may be selected for the contour of bracket 60. Alternative clamps that may be used include hose clamps and C-clamps.

Figure 4:
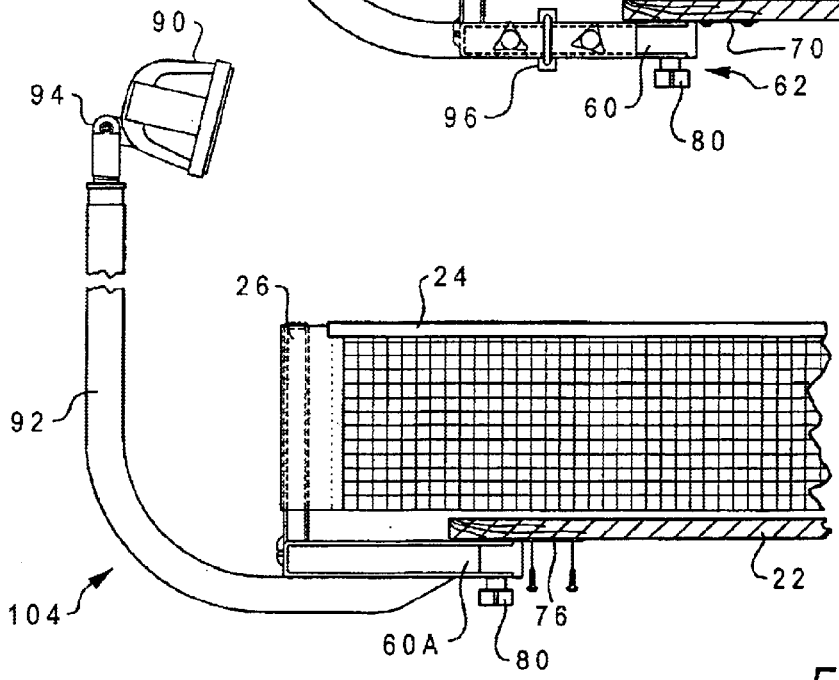
FIG. 4 is a side view of a combination game light and net post bracket in accordance with another embodiment of the present invention.
Figure 5:
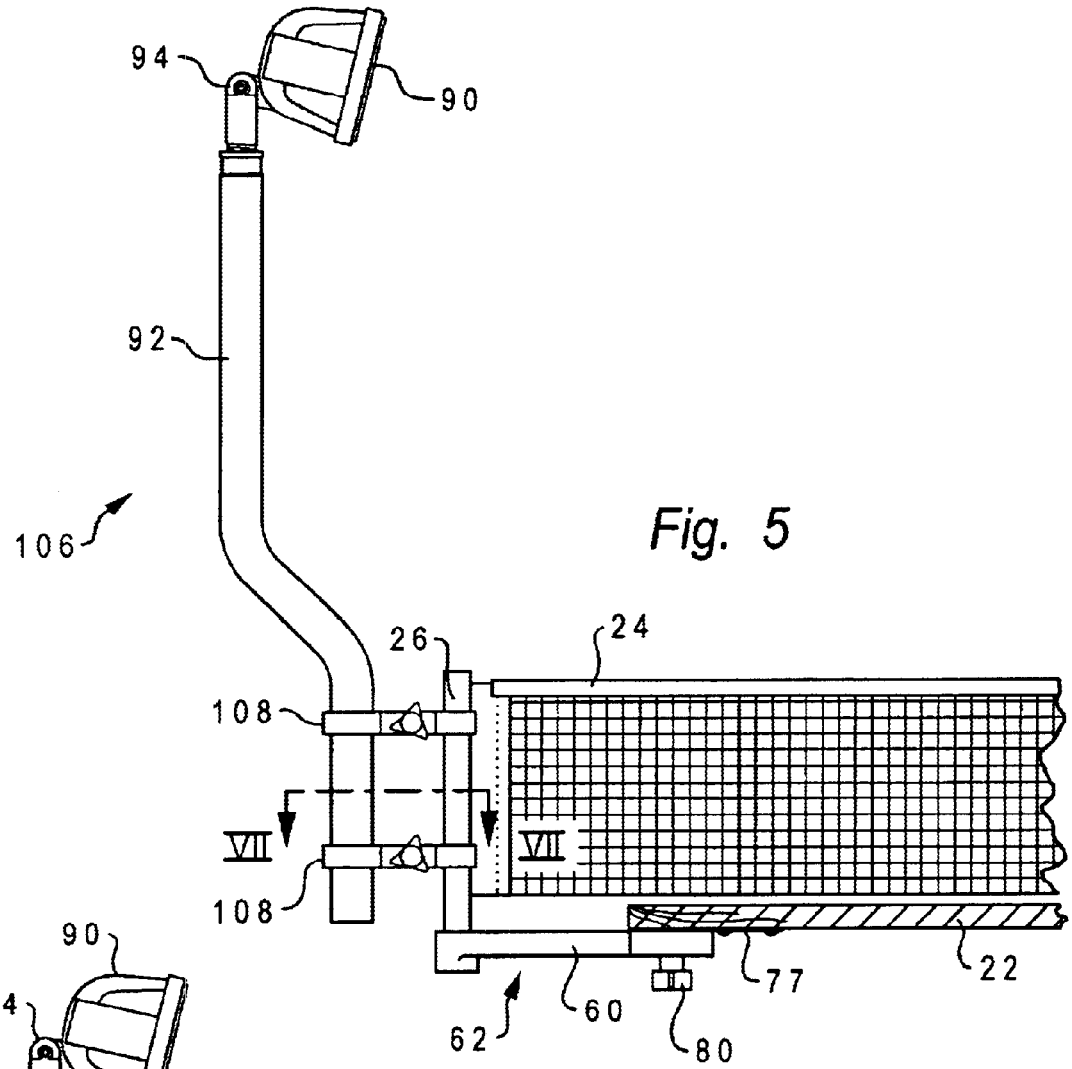
FIG. 5 is side view of a game light mounted to a net post in accordance with another embodiment of the present invention.

FIG. 4 shows game light 104, which is a combination game light and net post assembly, is intended to replace an existing net post assembly because the game light is integrated with bracket 60A and net post 26. Game light 104 replaces an original equipment net post assembly without a light. As shown, conduit 92 of game light 104 is an integral or constituent part of bracket 60A. In some embodiments, conduit 92 and bracket 60A are plastic and molded as a single piece, or conduit 92 and bracket 60A may be metal and welded together to form a single piece. In other embodiments, conduit 92 may be removably coupled to bracket 60A, so that bracket 60A and conduit 92 fit together as a unit by screwing together, or having one part inserted into another, or the like. If conduit 92 is removable, it may be locked in place with a bolt, screw, locking pin, or the like.

Figure 14:
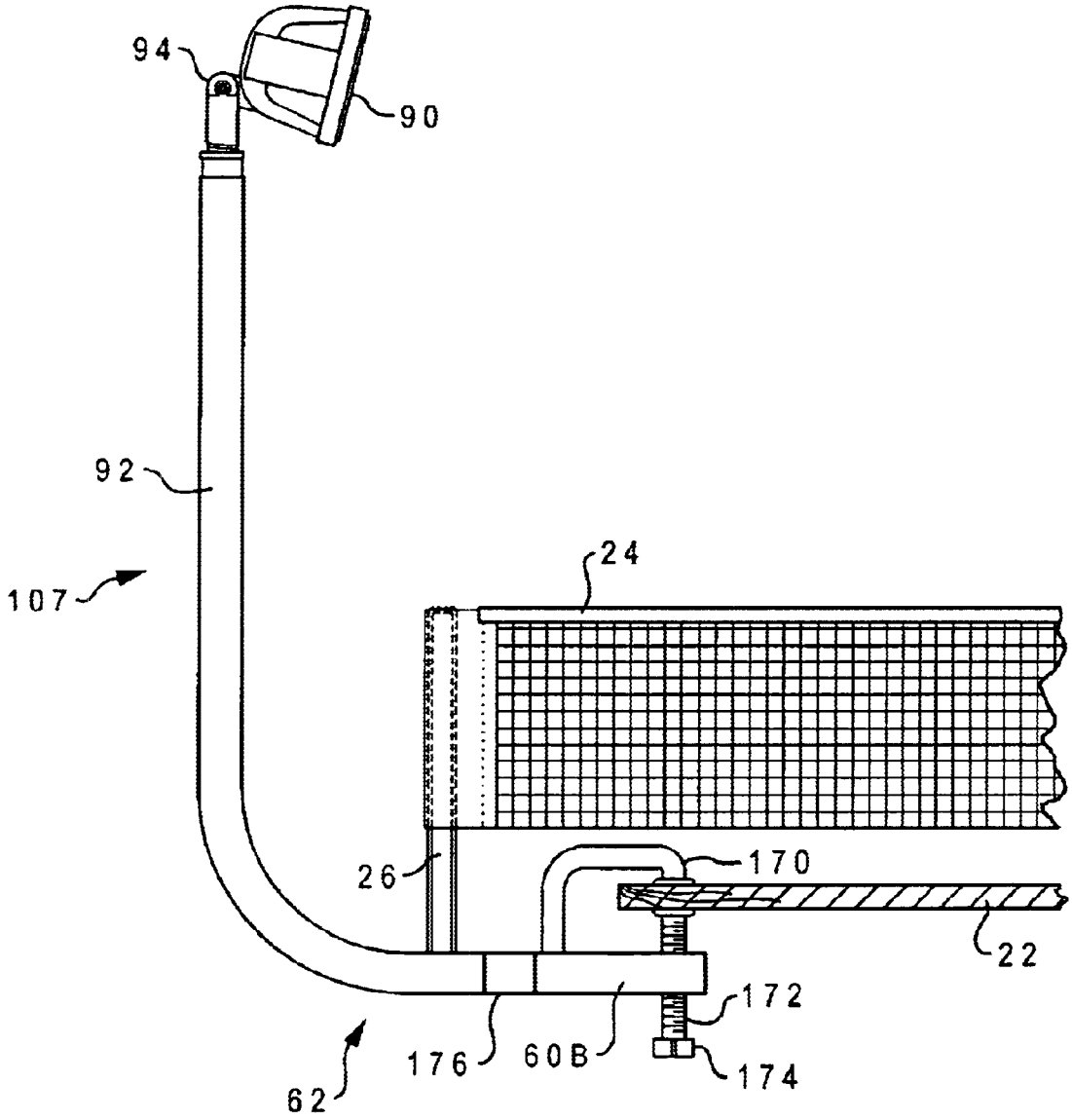
FIG. 14 is a side view of an embodiment of a combination game light and net post bracket that uses a C-clamp for mounting to the table, in it accordance with the present invention.

FIG. 14 shows game light 107, which is a combination game light and net post assembly that clamps to table 22. As depicted, clamp arm 170 engages the top of table 22 when clamp screw 172 is turned by knob 174 and tightened to engage the bottom of table 22. Bracket or beam 60B is the underside of the clamp 170 and extends out from the table side. The beam 60B has centering offset 176, which is substantially similar to the offset 176 shown on the beam or bracket 60 in FIG. 9. The offset is used to position net post 26 along the center line of table 22 when the clamp is clamped to one of the table-halves, just to the side of a center-line crack that may run between courts. The post 26 is coupled to the conduit 92, which conduit 92 is coupled to the offset 176.

In another embodiment of the invention, the game light is mounted to the net post rather than mounted to the bracket. In FIG. 5 there is depicted game light 106, wherein conduit 92 is coupled to net post 26 using one or more clamps 108. Embodiments of clamp 108 are shown in greater detail in FIGS. 7 and 8.

Figure 7:
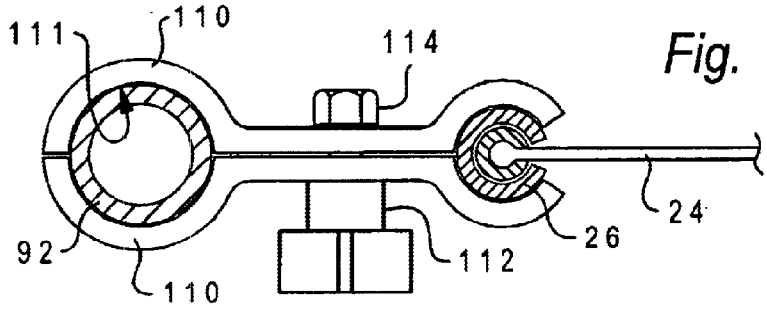
FIG. 7 is a top view, taken along a line VII—VII in FIG. 5, which shows a mounting clamp for mounting a game light to a net post in accordance with the present invention.

With reference now to FIG. 7, there is depicted a top view of a first embodiment of clamp 108 that couples conduit 92 to net post 26. Conduit 92 is shown in FIG. 7 as a cross-section view of a hollow tube. Net post 26 is shown as a cross-section view of a C-shaped post that has a slot facing to the right. A bead on the edge of net 24 slides into the C-shaped slot from the top, so that holding the bead in the center of the net post holds the net. A pair of clamp arms 110 extend around each side of net post 26 and conduit 92. Located between net post 26 and conduit 92 is bolt 112 and nut 114, which, together squeeze clamp arms 110 together to engage net post 26 and conduit 92 at a clamping surface. Since clamp 108 tightens with a screwing action, clamp 108 may be referred to as a screw clamp.

The clamping surfaces, or the surfaces of contact, of clamp arms 110 are preferably contoured to engage or contact a typical net post shape. Hence, a round clamping surface contour may be used to engage conduit 92, which has a round shape in the embodiment shown. For net posts and conduits having other selected shapes, clamp arms 110 may have clamping surface shapes in the clamp openings that correspond to the selected conduit shape.

Figure 8:
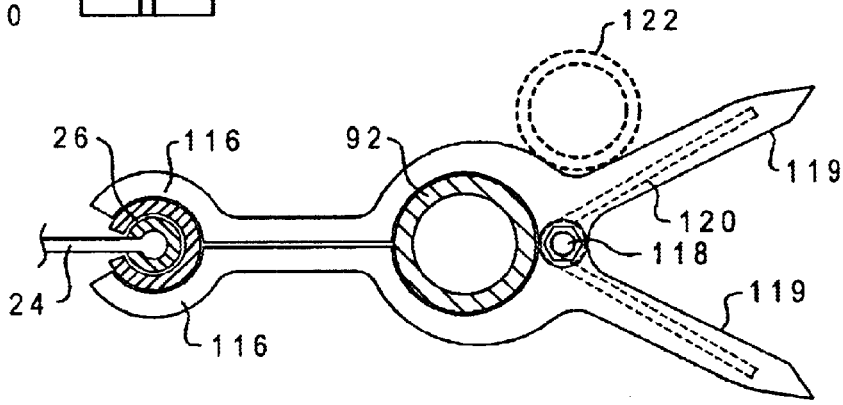
FIG. 8 is a top view of an alternate embodiment of a mounting clamp for mounting a game light to a net post in accordance with the present invention.

FIG. 8 shows an alternate embodiment of clamp 108 that uses springs to hold the clamp arms on the net post. Note that FIG. 8 shows the net extending to the left, while FIG. 7 shows the net extending to the right. As illustrated, clamp arms 116 are connected at hinge 118. Clamp arms 116 are held closed on net post 26 and conduit 92 by spring 120, which may wrap around hinge 118. To open clamp arms 116, handles 119 are squeezed together, and to close, handles 119 are released.

In an alternative embodiment, clamp arms 116 may clamp only to net post 22, and conduit 92 may be coupled to the outside of one of the clamp arms 116 (as shown by dashed lines 122) by a suitable sturdy connection, such as a nut and bolt, welding, riveting, gluing, or the like.

Both of the clamps shown in FIGS. 7 and 8 open and close in a plane perpendicular to the net post, and both clamps support the conduit in an orientation that extends upward and away from the net, such that the light source is positioned outside the perimeter of a playing court and above a net attached to the net post.

Figure 6:
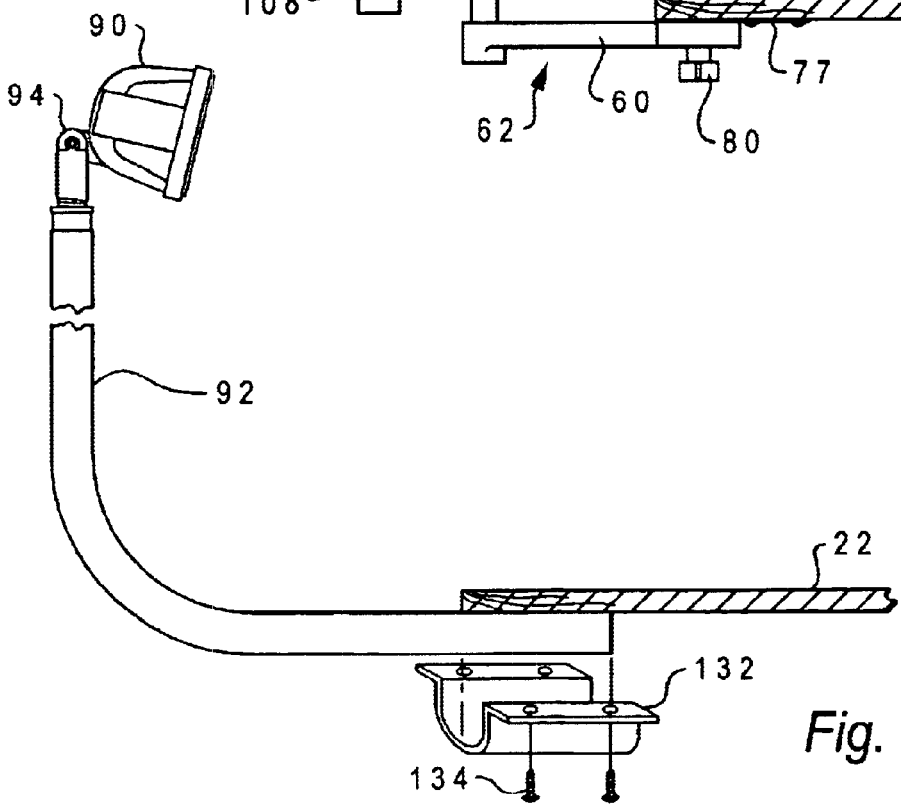
FIG. 6 is a side view of a game light for mounting to the bottom of a table in accordance with another embodiment of the present invention.

An embodiment of the present invention that attaches to the bottom of playing surface 22, independent of net post assembly hardware, is shown in FIG. 6. As illustrated, game light 130 includes conduit 92, which is coupled to the bottom of playing surface 22, preferably near an intersection or crossing of net 24 and side line 32, by mounting bracket 132, and mounting screws 134. Mounting bracket 132 may have a key, bolt, pin, or the like (not shown), which keeps conduit 92 from turning in mounting bracket 132, so that light housing 90 remains above playing surface 22 and conduit 92 is held perpendicular to playing surface 22.

Figure 10:
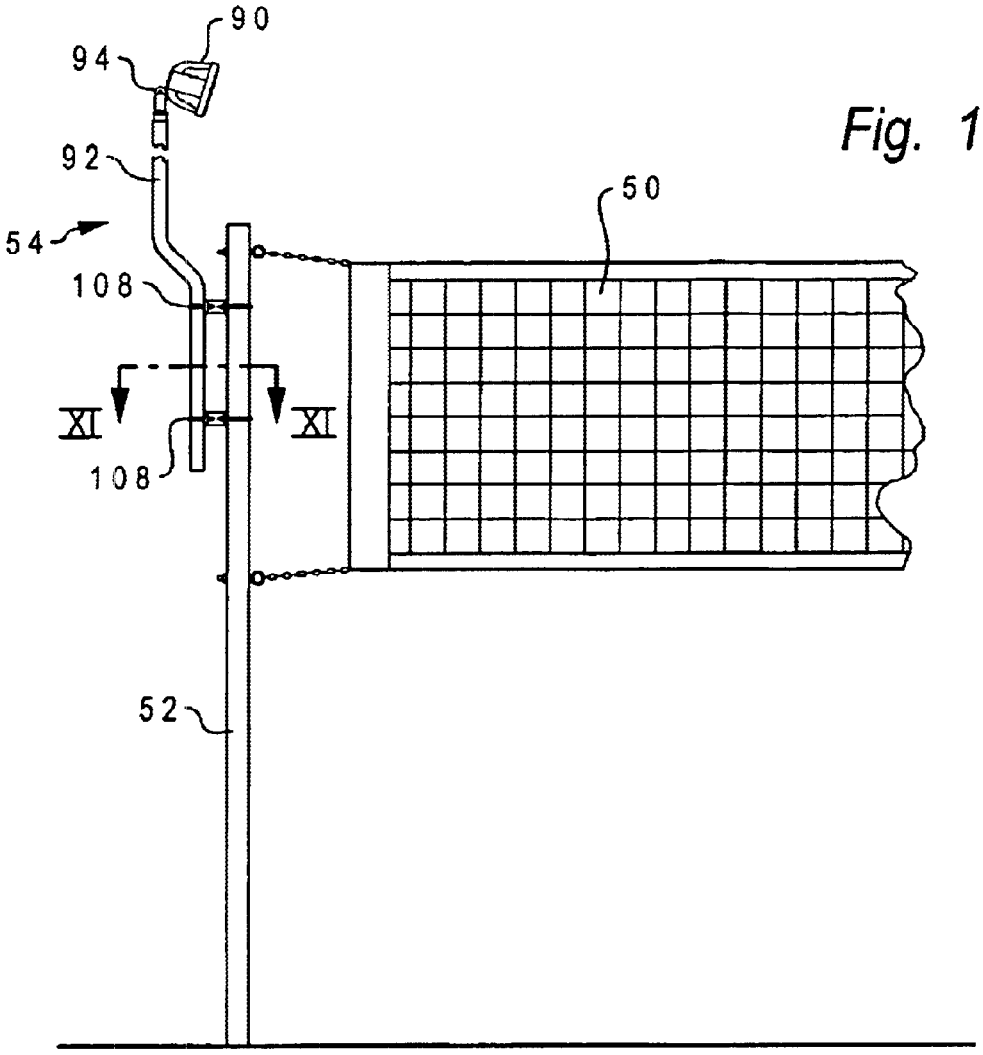
FIG. 10 is a side view of a game light mounted to a net post for volleyball in accordance with the present invention.

With reference now to FIG. 10, there is depicted a volleyball net 50 supported by net posts 52. Coupled to net post 52 is game light 54, which is similar to game light 106 for table tennis shown in FIG. 5.

Figure 11:
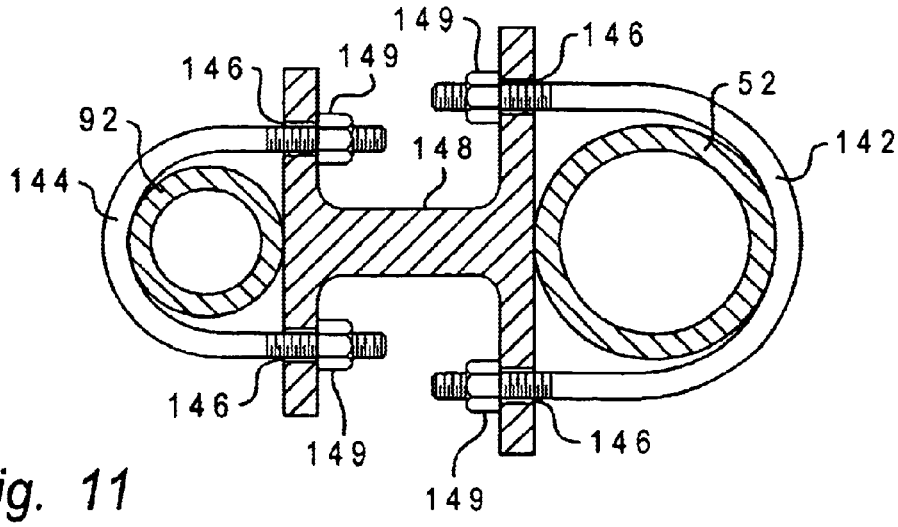
FIG. 11 is a top view, taken along a line XI—XI in FIG. 10, which shows a means for mounting a game light to a volleyball net post in accordance with FIG. 10 of the present invention.

Game light 54 is coupled to net post 52 with a one or more clamps, such as clamps 124, which is shown in more detail in FIG. 11. Game light 54 for volleyball is constructed on a larger scale than a table tennis light, so that conduit 92 may be larger in diameter, longer, and sturdier to support a larger light source for illuminating a larger playing surface.

Clamps similar to those shown in FIGS. 7 and 8 may also be used for volleyball, in which case net post 26 in FIGS. 7 and 8 would be substituted by net post 52, the net post used for volleyball.

When game light 54 is mounted to net post 52 for illuminating a volleyball game, the safety of the volleyball players is a concern. In order to avoid injury to volleyball players, the surfaces of conduit 92 and clamps 108 should be blunt and rounded so that if a player strikes the clamp, the possibility of injury is reduced. Some portions of conduit 92 and clamps 108 may be covered by a soft protective material. Additionally, nut 114 may be a rounded nut or knob having a lower profile, or clamp arms 110 may be designed to enclose bolt 112 and nut 114 by providing, for example, a countersunk recesses in clamp arms 110.

Referring now to FIG. 11, there is depicted a top view taken along line XI—XI in FIG. 10 showing a clamp assembly that may be used to couple game light 54 to net post 52 for a volleyball court. As shown, U-bolt 142 is selected to wrap around the relatively large net post 52, and smaller U-bolt 144 is selected with a diameter to wrap around conduit 92, which has a relatively small diameter. Both U-bolt 142 and 144 pass through openings 146 in clamp body 148, and are clamped tight by nuts 149. Clamp body 148, which is shown in section view, is I-shaped. In another embodiment, the face of clamp body 148 that contacts conduit 92 or net post 52 may be shaped to conform to the shape of post or conduit for better mounting and better distribution of forces.

Figure 12:
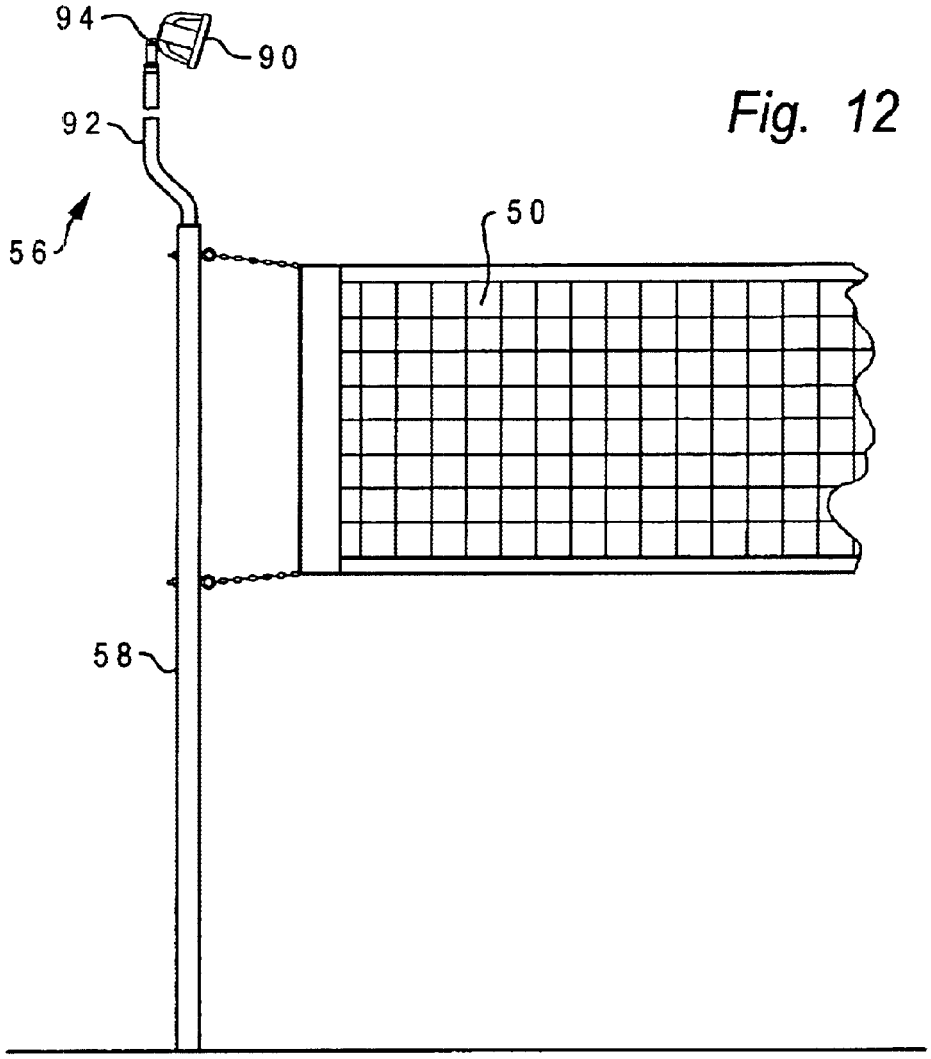
FIG. 12 is a side view of a combination game light and volleyball net post in accordance with the present invention.

In FIG. 12, there is depicted an alternate embodiment of a game light for volleyball, wherein game light 56 is integrated with, or is a constituent part of, net post 58. Similar to the table tennis embodiment shown in FIG. 4, game light 56 and volleyball net post 58 may be sold together as a replacement for an existing net post. In some embodiments, conduit 92 of game light 56 is molded or welded into a single piece with net post 58. In other embodiments, conduit 92 of game light 56 may be removably coupled to net post 58, so that conduit 92 fits into net post 58 by screwing the pieces together, or having conduit 92 inserted into a top opening in net post 58, or similar methods of removable coupling. To prevent conduit 92 from rotating with respect to net post 58, conduit 92 and net post 58 may be secured with a bolt, screw, locking pin, or the like. Additionally, conduit 92 and net post 58 may have a key and slot arrangement to prevent game light 56 from rotating out of position, where it may be come a hazard in the playing area close to net 50.

Figure 13:
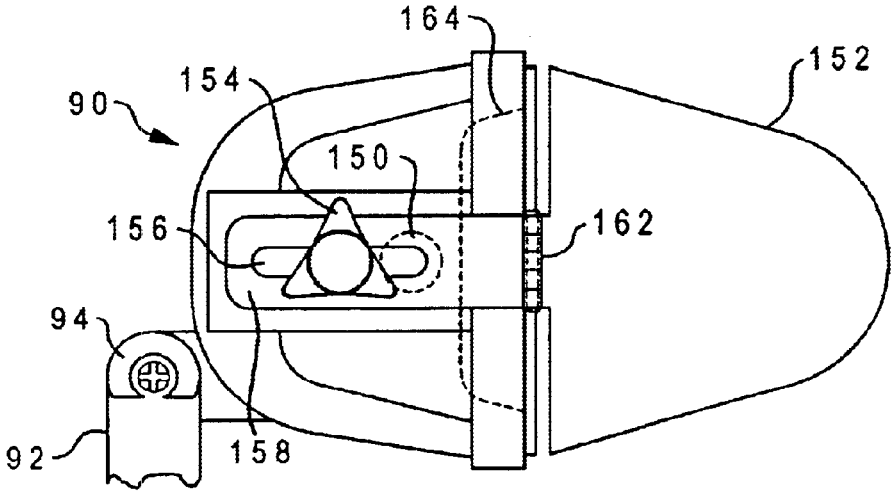
FIG. 13 is a side view of a light source housing having a shade in accordance with the present invention.

Referring now to FIG. 13, there is depicted a more detailed view of 30 light housing 90. As shown, light housing 90 includes pivot joint 94, which is used for pivotally coupling light housing 90 to conduit 92. Inside light housing 90 there is a socket (not shown) or other means for supporting and providing power to light source 150. Light source 150 may be any one of several means for providing light, such as an incandescent light bulb, a halogen light bulb, a krypton lamp, a high-pressure sodium bulb, a metal halide bulb, or the like. The power source may be alternating current line voltage or power from a battery.

Light housing 90 protects the light source from damage, protects players from contacting a hot bulb, and focuses and shades the light source so that light shines on table tennis playing surface 22 or volleyball playing surface 42, while shading the light source, as viewed by a player from many playing positions, from the players eyes.

To assist in shading the light source, FIG. 13 shows adjustable shades 152, which may be mounted on either side of light housing 90. Shade 152 is connected to shade arm 158, which may be mounted to light housing 90 using bolt 54, which extends through slot 156 in shade arm 158, and into threaded fitting in the side of light housing 90. Using the method of attachment, adjustable shades 152 may be extended or retracted or rotated upwardly or downwardly about bolt 54, in order to reduce and minimize glare in the player's eyes. Shades 152 may be translucent and tinted, or opaque. Adjustable shades 152 may be fixed to shade arm 158, or alternatively may be coupled with hinge 162, which provides a further adjustment for adjustable shades 152. Alternatively, adjustable shades 152 may be coupled by a hinge at the edge of the light source opening of light housing 90.

When in use, adjustable shades 152 are positioned to block light rays from passing directly from light source 150 into a player's eyes, without blocking light rays from falling upon playing surface 22 or 42, and without blocking light rays from illuminating net 24 or 50 and the area of play above net 24 or 50.

As an alternative to adjustable shades 152, light housing 90 may have translucent portions 164 in the sides of light housing 90.

The lights 90 for both the table top game shown in FIG. 1 and the court game shown in FIG. 2 are positioned laterally of the playing surface or area. Thus, the lights are not positioned so as to obstruct the field of play. Furthermore, the lights are positioned at an elevated position above the net. The lights are used to direct light towards the opposing side. The lights have a fairly broad illumination and therefore the light projects onto the playing surface in areas that are adjacent to both sides of the net. If two lights are used, one on each end of the net, the two lights may be offset slightly so that one light points more into one half of the playing surface while the other light points more to the opposing half of the playing surface.

The lights are mounted using either the net supporting structure, or in the case of a ping pong table, can be mounted independently of the net is supporting structure and directly to the table itself.

The foregoing description of a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A light for a game, wherein the game uses a net supported by a net post, wherein the net post has a net side from which a suspended net extends away from the net post, the light comprising:

a conduit having a light end and a mounting end;

a light source housing coupled to the light end of the conduit, wherein the light source housing has a socket for supporting and coupling power to a light source; and a mounting means coupled to the mounting end of the conduit for attaching the conduit to the net post, wherein the conduit has a lateral offset wherein the conduit extends upward and laterally away from the mounting means and a side of the net post opposite the net side, and wherein the light source is on the side of the net post opposite the net side for positioning the light source outside a perimeter of a playing court and higher than the net attached to the net post.

2. The light according to claim 1 wherein the mounting means is a clamp.

3. The light according to claim 2 wherein the mounting means is a screw clamp.

4. The light according to claim 2 wherein the mounting means is a spring clamp.

5. The light according to claim 2 wherein the clamp includes a clamp arm having a clamping surface shaped to conform to a corresponding shape of the net post.

6. The light according to claim 1 wherein tho conduit includes an offset that positions the light out of a space for playing the game when a coupled to a net post.

7. The light according to claim 6 wherein the conduit is a bendable shaft.

8. The light according to claim 2 wherein the clamp opens and closes in a plane perpendicular to the net post, and the conduit extends upward and away from the net such that the light source is outside the perimeter of a playing court and higher than a net attached to the net post.

9. The light according to claim 1 further including a light source shade coupled to the light source housing.

10. The light according to claim 9 wherein the light source shade blocks light from shining into the eyes of a player who is in a playing position between lines running along sidelines of the game.

* * * * *